US008274776B2

(12) United States Patent
Adler

(10) Patent No.: US 8,274,776 B2
(45) Date of Patent: Sep. 25, 2012

(54) DISABLING A TARGET USING ELECTRICAL ENERGY

(75) Inventor: Richard J Adler, Marana, AZ (US)

(73) Assignee: Applied Energetics, Inc, Tucson, AZ (US)

( * ) Notice: Subject to any disclaimer, the term of this patent is extended or adjusted under 35 U.S.C. 154(b) by 0 days.

(21) Appl. No.: 13/211,819

(22) Filed: Aug. 17, 2011

(65) Prior Publication Data

US 2011/0299216 A1 Dec. 8, 2011

Related U.S. Application Data

(63) Continuation of application No. 11/787,423, filed on Apr. 16, 2007, now Pat. No. 8,004,816.

(51) Int. Cl.
*H01T 23/00* (2006.01)
*F41B 15/04* (2006.01)
*F41H 13/00* (2006.01)

(52) U.S. Cl. ..... 361/232

(58) Field of Classification Search ..... 361/230–233; 89/1.11; 463/47.3; 231/7
See application file for complete search history.

(56) References Cited

U.S. PATENT DOCUMENTS

| | | | | |
|---|---|---|---|---|
| 6,999,295 | B2 * | 2/2006 | Watkins et al. | 361/232 |
| 7,145,762 | B2 * | 12/2006 | Nerheim | 361/323 |
| 7,296,503 | B1 * | 11/2007 | McGrath | 89/1.13 |
| 7,400,487 | B1 * | 7/2008 | Bitar | 361/232 |
| 7,675,731 | B2 * | 3/2010 | Bitar | 361/232 |
| 7,987,760 | B1 * | 8/2011 | Lundquist et al. | 89/1.13 |
| 8,004,816 | B1 * | 8/2011 | Adler | 361/232 |
| 2009/0059460 | A1 * | 3/2009 | Bitar | 361/232 |
| 2010/0264217 | A1 * | 10/2010 | Kumhyr et al. | 235/400 |
| 2011/0259181 | A1 * | 10/2011 | Lundquist et al. | 89/1.13 |
| 2011/0299216 | A1 * | 12/2011 | Adler | 361/231 |

* cited by examiner

*Primary Examiner* — Daniel Pihulic
(74) *Attorney, Agent, or Firm* — Duft Bornsen & Fishman LLP; Gregory T. Fettig

(57) ABSTRACT

One system described herein provides electrical energy by means of a Tesla coil that generates a strong electric field in the vicinity of an electrical target. An energy booster provides additional electrical energy to increase the probability of disabling and/or disrupting the electrical target. For example, an electrode may be configured with the Tesla coil to from the electric field of the electrical target. The electric field may cause a breakdown in the air about the Tesla coil that allows electric current to conduct to the electrical target. The Tesla coil may repetitively burst the electric field such that pulses of electric current are conducted to the electrical target.

25 Claims, 4 Drawing Sheets

DISABLING A TARGET USING ELECTRICAL ENERGY

CROSS-REFERENCE TO RELATED APPLICATIONS

This patent application claims is a continuation patent application claiming priority to and thus the benefit of an earlier filing date from U.S. patent application Ser. No. 11/787,423. Now U.S. Pat. No. 8,004,816 (filed Apr. 16, 2007 issued Aug. 23, 2011), the entire contents of which are hereby incorporated by reference.

BACKGROUND

Electrical energy can exist naturally (e.g., lightning and static electricity). Electrical energy can also be man-made and used in a variety of well-known constructive manners. Relative high voltage electrical energy has its constructive uses although its specific applications are often more narrowly tailored than common household voltage levels. For example, high voltage applications may be found in particle accelerators and X-ray devices.

The particularly high voltage levels and unpredictability of lightning, however, have generally been deemed as nuisances. For example, when lightning strikes an unprotected electrical system, the electrical system may be destroyed by the incredibly strong electrical current flowing through the system. On the other hand, generating such "lightning-like" electrical energy could prove useful if properly harnessed. For example, directing high-voltage electrical energy to a target from some "stand-off" distance may provide the ability to disable, disrupt, and/or destroy the target in a security related application without causing injury to the user.

SUMMARY

The systems and methods presented herein generally provide for disrupting or disabling electrical targets, such as an electrically actuated explosive. One system described herein does so by means of a Tesla coil that generates a strong electric field in the vicinity of the electrical target. For example, an electrode may be configured with the Tesla coil to form the electric field proximate to the electrical target. The electric field may cause a breakdown in the air between the device and the Tesla coil that allows electric current to conduct directly to the electrical target. For example, this current can disrupt the electrical target by interacting with the electronic circuit of the target. In this regard, the Tesla coil may repetitively burst the electric field such that pulses of electric current are conducted to the electrical target. Alternatively or additionally, the electric field may induce electric current in the device that damages the electrical target. While the Tesla coil is generally capable of generating an electric field to disable/destroy an electrical target, an energy boost circuit may contain conductors which increase the electric field in its proximity. These electric fields can increase the probability of breakdown to the electrical target.

In one embodiment, an electrical target disruptor includes a power supply that provides first electrical energy and a loosely coupled transformer coupled to the power supply, wherein the loosely coupled transformer increases voltage of the first electrical energy. The disruptor also includes an electrode coupled to the loosely coupled transformer to discharge the first electrical energy and a switch coupled to the loosely coupled transformer that pulses the first electrical energy to the electrode. The disruptor also includes an energy booster coupled to the electrode through at least a portion of the loosely coupled transformer to provide second electrical energy to the electrode and disrupt an electrical target.

The electrode may include a configuration that induces discharge of the electrical energy. The power supply may include AC electrical energy having a voltage of at least 10 kilovolts. The energy booster may include a second power supply that provides the second electrical energy to the electrode. The energy booster may also include a switch coupled to the second power supply to control the transfer of the second electrical energy to the electrode.

In another embodiment, a system that disables an electrical target includes a power supply that provides first electrical energy and an energy booster coupled with the power supply to provide second electrical energy. The system also includes an electrode coupled to the power supply and to the energy booster to discharge the first and the second electrical energies.

The system may further include a loosely coupled transformer coupled between the power supply and the electrode to increase a voltage of the first electrical energy. The system may further include a switch coupled to the loosely coupled transformer to pulse the first electrical energy through the loosely coupled transformer. For example, the loosely coupled transformer may be a Tesla coil. The switch may be a thyratron. The switch may pulse the electrical energy at a rate greater than about 100 Hz. The loosely coupled transformer may provide at least 2 A of electrical current for about 0.1 milliseconds. The system may further include a switch coupled to the energy booster to pulse the second electrical energy. The switch may pulse the electrical energy at a rate greater than about 100 Hz.

In another embodiment, a method of disabling an electrical target includes providing first electrical energy to an electrode to generate an electric field thereabout and providing second electrical energy to the electrode. The method also includes positioning the electrode proximate to an electrical target such that the first and the second electrical energies disable the electrical target. Providing the first electrical energy may include switching the first electrical energy to the electrode with a thyratron. Providing the second electrical energy may include switching the second electrical energy to the electrode after providing the first electrical energy to the electrode.

The method may further include stepping up voltage of the first electrical energy with a transformer. The transformer may be a loosely coupled transformer. For example, the transformer may be a Tesla coil. The method may further include generating the first electrical energy with a high voltage power supply. The method may further include discharging the first and the second electrical energies from the electrode to the electrical target. Positioning the electrode proximate to the electrical target may include inducing electric current flow in the electrical target with the electric field of the electrode to at least disable electronics of the electrical target. Providing the first electrical energy may include generating electrical energy at a voltage of at least 10 kV. Providing the second electrical energy may include transferring the electrical energy with a current of about 10 A.

DETAILED DESCRIPTION OF THE DRAWINGS

Figure 1:
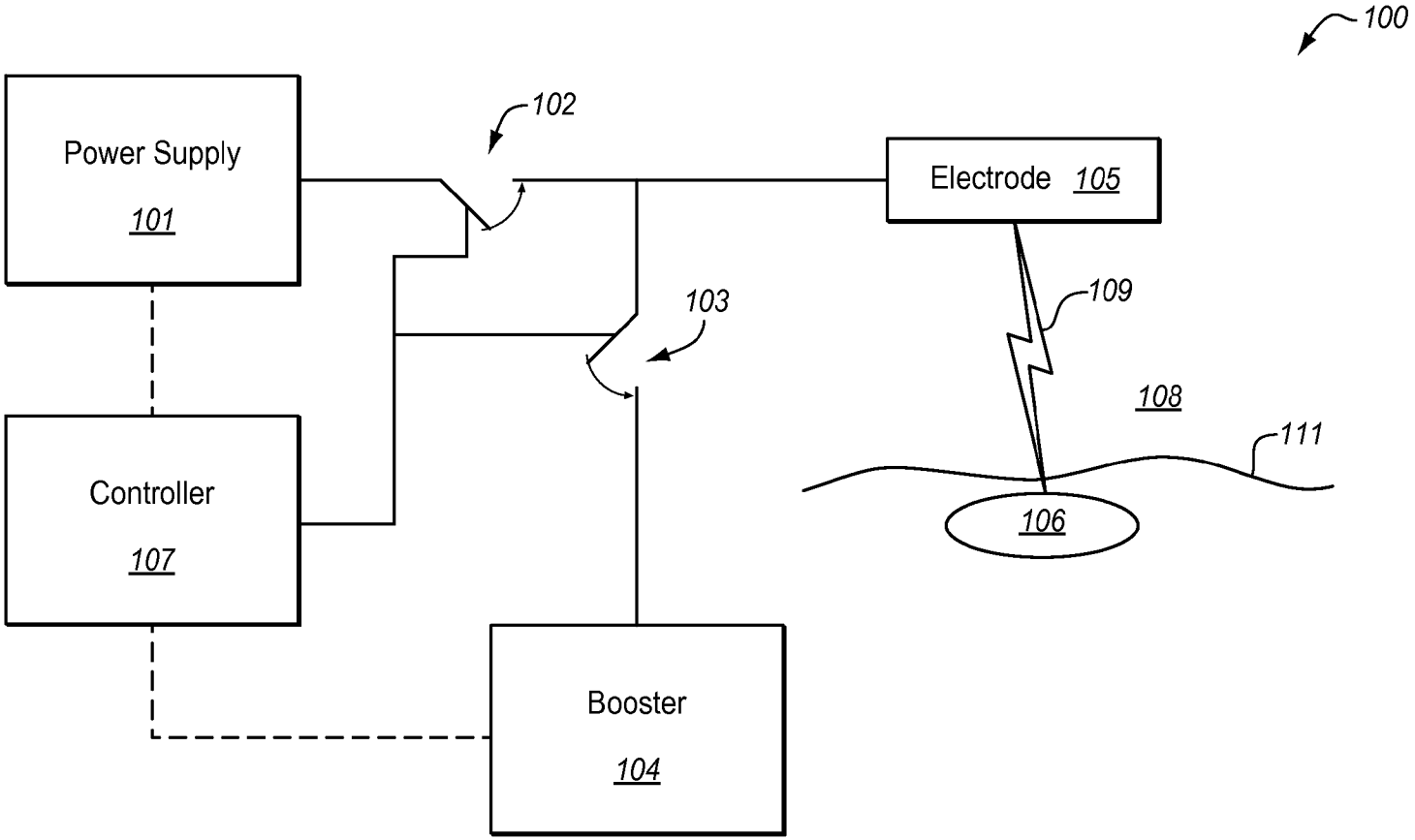
FIG. 1 is a block diagram of an exemplary system for delivering electrical energy to an electrical target.

While the invention is susceptible to various modifications and alternative forms, specific embodiments thereof have been shown by way of example in the drawings and are herein described in detail. It should be understood, however, that it is not intended to limit the invention to the particular form disclosed, but rather the invention is to cover all modifications, equivalents, and alternatives falling within the scope and spirit of the invention as defined by the claims.

FIG. 1 is a block diagram of system 100 that delivers electrical energy to electrical target 106 for the purposes of disrupting, destroying, and/or disabling the electrical target. In this embodiment, system 100 is configured with power supply 101 and energy booster 104 to respectively provide first and second electrical energies to electrode 105. For example, power supply 101 may burst electrical energy to electrode 105 to generate an electric field thereabout. The electric field may cause breakdown 109 in air region 108, which allows electrical energy to conduct to electrical target 106. Alternatively or additionally, the electric field generated about electrode 105 may induce electric current to flow within conductive components of electrical target 106. For example, electrical target 106 may include triggering circuits which work electrically. An electric field proximate to electrical target 106 may cause electric current to flow therein so as to disrupt and/or damage the circuitry and thereby disable the electrical target.

In this regard, power supply 101 may be configured to provide high voltage energy to energize electrode 105. A first switch 102 generally controls the delivery of electrical energy from power supply 101 to electrode 105. A second switch 103 connects electrode 105 to energy booster 104. In this regard, operation of the system 100 may happen in at least two phases. For example, prior to disrupting/disabling electrical target 106, switch 102 and switch 103 may both be open. Initially, switch 102 closes, thereby allowing power supply 101 to energize electrode 105.

Energy booster 104 may provide additional electric current to electrode 105 to assist in the disruption or disabling of electrical target 106. The additional electric current may relieve power supply 101 of energy delivery burdens and allow the power supply to recover. For example, power supply 101 maybe a Tesla coil wherein electrical energy resonates and ultimately discharges from electrode 105 when electrical energy is applied to the primary coil of the Tesla coil. In one embodiment, the Tesla coil can provide electric current that is capable of igniting an explosive material. In such an embodiment, the duration of the provided electric current is typically less than 100 μs. Even electrical energy with exceptionally high voltage (e.g., greater than 100 kV) may need more than 100 μs to heat an explosive material to the point of ignition. Repetitive bursts of the Tesla coil energy may be required in order to reach the requisite temperature for ignition of the explosive material of electrical target 106. In this regard, energy booster 104 may provide an additional electric current to heat the explosive material to the point of ignition without additional bursts of electrical energy from power supply 101.

In one embodiment, the electrical energy provided by energy booster 104 maintains breakdown 109 between electrode 105 and electrical target 106. For example, power supply 101 may provide enough electrical energy to initiate a breakdown between electrode 105 and electrical target 106 such that electric current conducts from the electrode to the electrical target. The energy booster 104 may provide a requisite amount of electrical energy that sustains the breakdown such that the burdens on power supply 101 to deliver electrical energy are relieved. That is, energy booster 104 may provide enough electrical energy to keep air region 108 (i.e., where breakdown 109 occurs) sufficiently heated such that electrode 105 may conduct the electrical energy from energy booster 104 to electrical target 106. Power supply 101 may, thereafter, be decoupled from electrode 105.

In this regard, switch 102 may open and the switch 103 may close. Energy booster 104 may, therefore, be coupled to electrode 105 to allow current to flow from energy booster 104 to electrode 105. The electric current flow to electrical target 106 may at least sustain breakdown 109 and heat an explosive material of electrical target 106 to the point of ignition. Alternatively, the additional current may disable the electronics of the electrical target 106.

System 100 may also be configured with controller 107 to provide the system with various control features. For example, controller 107 may be communicatively coupled to switch 102 and switch 103 to control switching. In this regard, controller 107 may generate a control signal that closes switch 102 when electrical energy is to be delivered from power supply 101 to electrode 105. When additional electrical energy is to be delivered from energy booster 104, controller 107 may close switch 103 thereby electrically connecting the energy booster to electrode 105. Additionally, controller 107 may be communicatively coupled to power supply 101 and/or energy booster 104 to regulate the electrical energy delivered. For example, controller 107 may control parameters, such as voltage and/or current, of the electrical energy in which power supply 101 and/or energy booster 104 delivers to electrode 105. Additionally, controller 107 may control delivery parameters such as pulse width, pulse repetition interval, and/or pulse repetition frequency.

The magnitude of electrical energy provided by power supply 101 and/or energy booster 104 may be sufficient to penetrate layer 111 (e.g., natural ground) depending on the conductivity of the ground. For example, the electric potential between electrode 105 and electrical target 106 may be sufficient to create breakdown 109 such that electrical current conducts from electrode 105 to electrical target 106 through a layer of earth (e.g., dirt and/or other materials). While the electric potential needed to form and/or maintain breakdown 109 depends on a plurality of factors (e.g., ambient temperature of air region 108, impurities within the air region, depth of electrical target 106 under layer 111, distance between electrode 105 and electrical target 106, etc.), power supply 101 is generally capable of providing greater than 100 kV of electrical energy. Examples of electric breakdowns, such as breakdown 109, of air region 108 occur naturally, albeit uncontrollably, in the form of an arc of electrical energy known as lightning.

Figure 2:
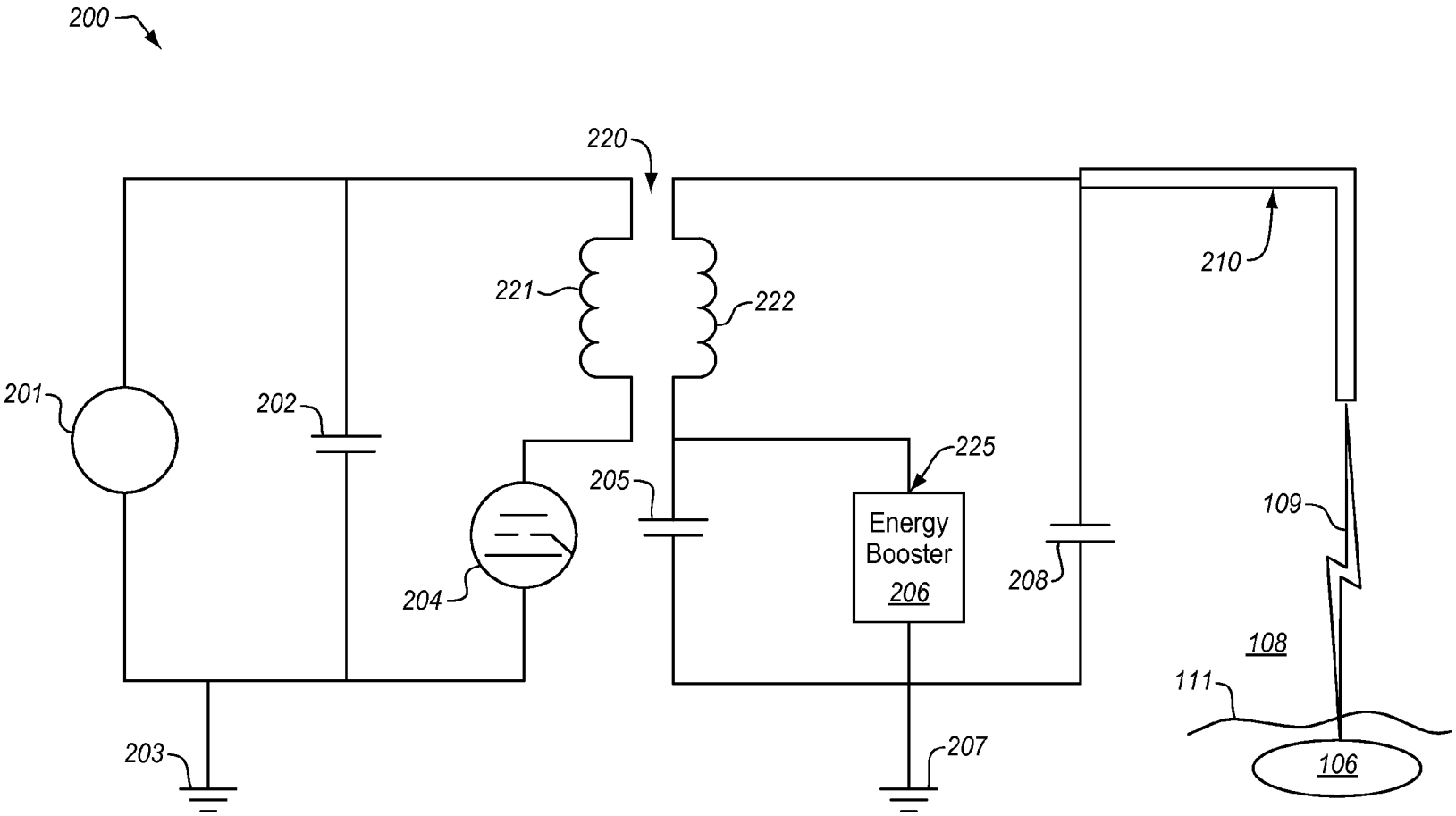
FIG. 2 is a circuit diagram of an exemplary system for delivering electrical energy to an electrical target.

FIG. 2 is a circuit diagram of system 200 for delivering electrical energy to electrical target 106. In this embodiment, high-voltage power supply 201 and capacitor 202 provide electrical energy to transformer 220 (e.g., a Tesla coil), which is used to supply the electrical energy to electrode 210, as controlled by thyratron 204. For example, high-voltage power supply 201 may be capable of delivering high-voltage electrical energy to transformer 220. In one embodiment, high-voltage power supply 201 may include a diesel-powered generator capable of generating voltages of at least 10 kilovolts AC. The electrical energy is stored by capacitor 202 (which may have a capacitance of about 400 pF) and delivered to primary coil 221 of transformer 220. Based on the "turns ratio" and "resonance" between primary coil 221 and secondary coil 222, the voltage of the electrical energy may be substantially stepped up for delivery to electrode 210.

Thyratron 204 provides a switching mechanism which allows electric current to conduct to electrode 210. For example, when thyratron 204 operably closes, electric current from high-voltage power supply 201 conducts through primary coil 221, thereby inducing electric current through secondary coil 222. Thyratrons, such as thyratron 204, are commonly used for switching high-voltage electrical energy. In this regard, thyratron 204 may be used to "pulse" electrical energy from high-voltage power supply 201 through primary coil 221. Although system 200 is illustrated and described as employing a thyratron, those skilled in the art will recognize that other types of switches may be employed, including, but not limited to, semiconductor switches.

Tesla coil configurations generally have relatively large turns ratios and very loose couplings. Coupling is generally referred to as the extent to which the magnetic field of each coil overlaps the other coil. Coupling can range from 0% (i.e., no interaction) to 100% (i.e., full interaction). In practice, 100% coupling is not possible, as some of the magnetic field will remain outside of the opposite coil. Coils with more than 50% coupling are said to be tightly coupled, while coils with less than 50% coupling are loosely coupled. Tesla coils generally have a coupling of 10% or less. Although described with respect to a Tesla coil, those skilled in the art should readily recognize that the invention is not intended to be limited to such. Other forms of loosely coupled coils may be used as a matter of a design choice. For example, as voltage requirements decrease, the coil coupling percentage of primary coil 221 and secondary coil 222 may increase. Additionally, those skilled in the art of designing and building Tesla coils will recognize that the above values can be varied while still achieving the desired results of producing strong electric fields around electrode 210 for the purposes of discharging electrical energy therefrom. In one embodiment, a turns ratio of 7:1000 may be used with a coupling coefficient of approximately 0.1. Those skilled in the art should readily recognize that the same or similar effects can be produced with systems using tightly coupled transformers.

As stated, transformer 220 steps up the voltage of high-voltage power supply 201, which may in turn be used to generate a strong electric field around an electrode 210. And, the output capacitor 208 may have a capacitance of 50 pF. That is, as electric current is induced in secondary coil 222, the electrical energy is delivered to electrode 210 which thereby produces an electric field. The electrical energy delivered to electrode 210 may be stored by capacitor 206 (e.g., having a capacitance of about 50 pF) to produce a resonant waveform and, thus, a higher electric field. When this electric field is moved into proximity with electrical target 106, it may cause electric breakdown 109 of air region 108 between electrode 210 and electrical target 106, resulting in electric current flowing from the electrode to the electrical target. Even without breakdown 109 occurring, the strong electric field around electrode 210 may induce electric current flow within electrical target 106 to disable and/or disrupt the target.

In some instances, repeated bursts of the electrical energy may be required to reach the requisite temperature for ignition of an explosive material of an electrically actuated explosive. However, this requirement may be relieved with the addition of energy booster 206 being superimposed upon the circuit of system 200. For example, energy booster 206 may be coupled between capacitor 205 (which may have a capacitance of about 10 μF) and secondary coil 222. Energy booster 206 may provide additional electrical energy to charge capacitor 205. The Tesla coil of this embodiment is generally configured as having a short circuit current of about 8 amperes (A) with a time scale of lesson about 0.1 ms Full Width at Half Maximum (FWHM). Energy booster 206, on the other hand, is generally configured to provide a peak current of about 10 A with a time scale of about 1 ms FWHM. Thus, a single pulse from energy booster 206 may deliver as much current as several bursts of Tesla coil energy. Since Tesla coils generally require larger amounts of energy to generate a single burst, energy booster 206 may provide a more efficient means of igniting or disabling electrical targets than a Tesla coil alone.

Energy booster 206 may be switched on to charge capacitor 205 such that the capacitor discharges through secondary coil 222. In one embodiment, energy booster 206 provides 10 amps of electric current for about 1 ms or less. This electrical energy, once discharged from capacitor 205, conducts to electrode 210 to provide electrical energy in addition to the electrical energy provided by high-voltage power supply 201 (i.e., via transformer 220). A controller may control switching aspects of system 200 to electrode 210 in a manner similar to controller 107 of FIG. 1. Such a controller may also be used to control the switching functionality of thyratron 204.

This boost of electrical energy provided by energy booster 206 may be used to Maintain breakdown 109. For example, electric potential provided by high-voltage power supply 201 via transformer 220 may be sufficient to cause an electric breakdown of air region 108 such-that electrical energy conducts from electrode 210 to electrical target 106. Once high-voltage power supply 201 is switched of by thyratron 204, energy booster 206 may be switched on to provide electrical energy to electrode 210. Generally, the electrical energy required for causing an electric breakdown of air region 108 is greater than the requirement for maintaining the breakdown. Accordingly, the 10 A of electric current may be sufficient to maintain breakdown 109 after electrode 210 discharges the electrical energy provided by high-voltage power supply 201 and transformer 220. Thus, once the burst of Tesla coil energy creates a conductive path to the electrical target 106, the electrical target 106 may be disrupted/disabled more efficiently by energy booster 206 without the need for repeated bursts of Tesla coil energy.

Figure 3:
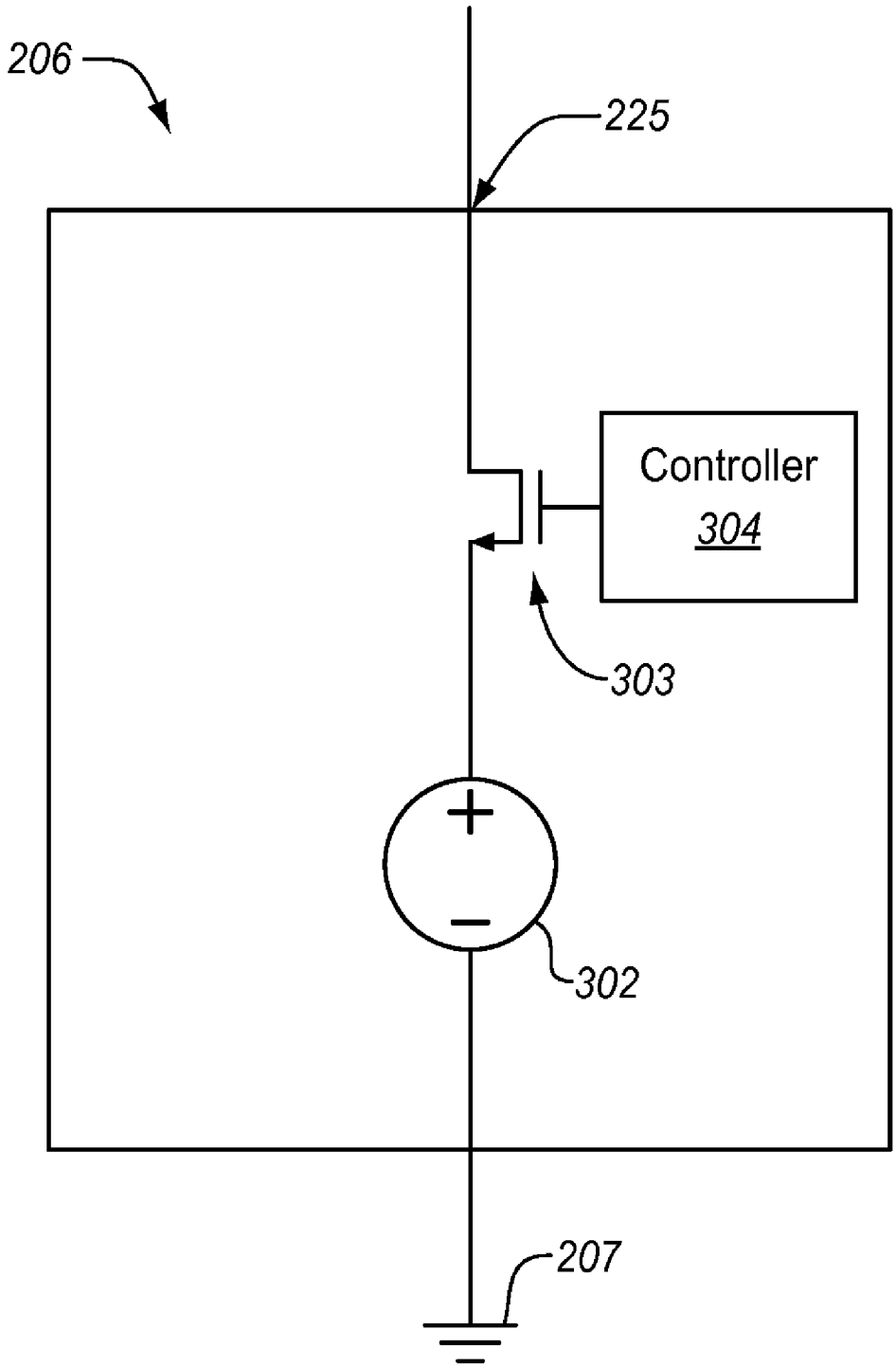
FIG. 3 is an exemplary circuit diagram of an energy booster illustrated in FIG. 2.

FIG. 3 illustrates an exemplary circuit diagram of energy booster 206 of FIG. 2. In this embodiment, energy booster 206 includes controller 304 coupled to a gate of Field Effect Transistor (FET) 303 to control the switching functionality of the FET. Energy booster 206 also includes power supply 302 which is used to supply the additional power to electrode 210 when, for example, high-voltage power supply 201 is decoupled from electrode 210 via thyratron 204. As described hereinabove, power supply 302 may be configured to provide about 10 A of electric current for about 1 ms. This electric current may charge capacitor 205 FIG. 2, then be decoupled from electrode 210. In this regard, capacitor 205 may discharge electrical energy to electrode 210 to contribute to the electric field (e.g., increase the electric field and/or maintain breakdown 109).

Figure 4A:
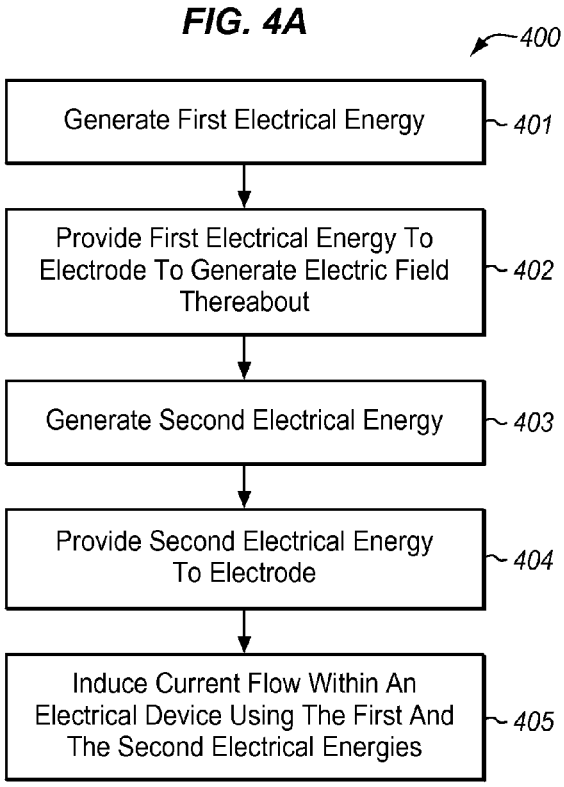
FIGS. 4A and 4B are flowchart illustrating exemplary processes for disabling an electrical target.
Figure 4B:
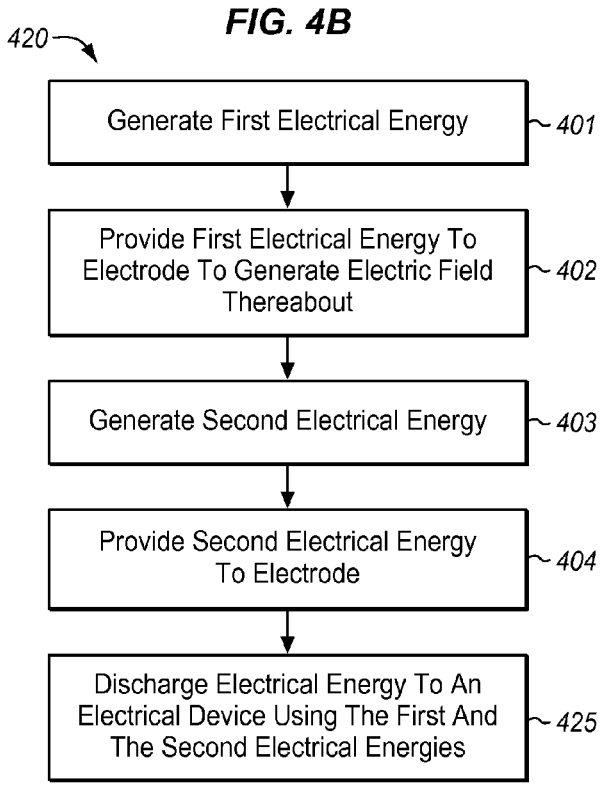

FIGS. 4A and 4B are, respectively, flowcharts 400 and 420 illustrating exemplary processes for disabling an electrical target. In each embodiment, first electrical energy is generated, in process element 401. For example, a high-voltage power supply may be configured to generate high-voltage electrical energy. The voltage of this electrical energy may be stepped up using a transformer, such as a Tesla coil or a loosely coupled transformer as described hereinabove. The first electrical energy may then be provided to an electrode, such as electrode 210 of FIG. 2, to generate an electric field thereabout, in process element 402. In this regard, the first electrical energy may be transferred through the transformer by means of a high-voltage switch, such as thyratron 204 of FIG. 2. A high-voltage switch allows electric current from the high-voltage power supply to conduct through a primary coil of the transformer. This conduction through the primary coil induces electric current within a secondary coil of the transformer and, based on a turns ratio between the two coils, increases the voltage of the electrical energy. The stepped up electrical energy is then transferred to the electrode to form an electric field thereabout.

The electric field formed with the electrode may be strong enough to create a breakdown in a gaseous region, such as air region 108 described hereinabove. For example, when the electrode comes within proximity of a conductive material and when the electric potential between the electrode and the conductive material is strong enough, the gaseous region between the electrode and the conductive material may preferably breakdown and conduct electric current from the electrode to the conductive material. In this regard, when an electrode includes a strong enough electric field and passes within proximity of an electrical target, the electrode may discharge electrical energy to electrical target, thereby igniting the explosive material contained therein and/or disabling/destroying the electronics thereof.

As described hereinabove, the electrical energy may be supplemented by an energy booster, such as energy booster 206 of FIG. 2. That is, the energy booster may relieve system of continuous high-voltage generation that is necessary to disable/disrupt an electrical target. In this regard, the energy booster may generate (process element 403) and provide (process element 404) additional/second electrical energy to the electrode to either increase the electric field thereabout or provide additional electrical energy discharge from the electrode. For example, once an electric field is formed by the first electrical energy, the addition of the second electrical energy from the energy booster may increase the electric field such that the likelihood of current being induced in an electrical target is also increased, in process element 405 of FIG. 4A. On the other hand, if the first electrical energy is sufficient to create a breakdown in the gaseous region, the breakdown may be sustained by the addition of the second electrical energy from the energy booster. That is, the second electrical energy will continue to discharge from the electrode to the electrical target even after the first electrical energy is decoupled from the electrode, in process element 425 of FIG. 4A.

While the invention has been illustrated and described in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Accordingly, it should be understood that only the preferred embodiment and variants thereof have been shown and described and that all changes and modifications that come within the spirit of the invention are desired to be protected. Regardless of the terminology (i.e., disable, destroy, ignite, etc.), the overall objective of the various systems and methods described herein is to prevent an electrical target from being used. The invention, therefore, is not intended to be limited to a particular result achieved and that terms such as disable, destroy and ignite may be used interchangeably.

What is claimed is:

1. A system for disabling an electrical target, including:

a power supply operable to provide electrical energy;

a loosely coupled transformer coupled to the power supply and operable to increase voltage of the electrical energy;

an electrode coupled to the loosely coupled transformer and operable to initiate a discharge of the electrical energy between the electrode and the electrical target;

a controller operable to pulse the electrical energy discharge to the electrical target to disable the electrical target; and an energy booster operable to maintain the electrical energy discharge to the target.

2. The system of claim 1, wherein the controller is further operable to decouple the loosely coupled transformer from the electrode to relieve energy consumption of the power supply while the energy booster maintains the electrical energy discharge to the target.

3. The system of claim 1, wherein the pulsed electrical energy has a voltage sufficient to penetrate natural ground.

4. The system of claim 1, wherein the electrical energy from the power supply has a voltage of at least 100 kV.

5. The system of claim 1, wherein the loosely coupled transformer has a coupling coefficient of approximately 0.1.

6. The system of claim 1, wherein the loosely coupled transformer is a Tesla coil.

7. The system of claim 1, further including a switch communicatively coupled to the controller and operable to pulse the electrical energy through a primary coil of the loosely coupled transformer.

8. The system of claim 7, wherein the switch is a thyratron.

9. The system of claim 7, wherein the switch pulses the electrical energy at a rate greater than about 100 Hz.

10. The system of claim 1, wherein the electrical target is buried under natural ground and the electrical energy has a voltage sufficient to penetrate the natural ground to the electrical target.

11. The system of claim 1, wherein the voltage of the electrical energy is sufficient to break down a gaseous region between the electrode and the electrical target to discharge from the electrode to the electrical target.

12. The system of claim 1, wherein the voltage of the electrical energy is sufficient to break down a gaseous region between the electrode and the electrical target to discharge from the electrical target to the electrode.

13. A method disabling an electrical target, including:

pulsing electrical energy from a power supply;

providing the pulsed electrical energy through a loosely coupled transformer to increase voltage of the pulsed electrical energy;

providing the pulsed electrical energy from the loosely coupled transformer to an electrode;

forming a discharge of the pulsed electrical energy between the electrode and the electrical target to disable the electrical target;

boosting the pulsed electrical energy by coupling another power supply to the loosely coupled transformer; and controllably switching the other power supply with the pulsed electrical energy.

14. The method of claim 13, further including decoupling the loosely coupled transformer from the electrode to relieve energy consumption of the power supply while the other power supply maintains the electrical energy discharge to the target.

15. The method of claim 13, wherein forming a discharge of the pulsed electrical energy between the electrode and the electrical target includes discharging the pulsed electrical energy from the electrode through air to the electrical target.

16. The method of claim 13, wherein forming a discharge of the pulsed electrical energy between the electrode and the electrical target includes discharging the pulsed electrical energy from the electrode through natural ground to the electrical target.

17. The method of claim 13, wherein forming a discharge of the pulsed electrical energy between the electrode and the electrical target includes discharging the pulsed electrical energy from the electrical target to the electrode.

18. The method of claim 13, further including positioning the electrode proximate to the electrical target to reduce the voltage required for forming the discharge of the electrical energy.

19. The method of claim 18, wherein positioning the electrode proximate to the electrical target includes placing the electrode in contact with natural ground under which the electrical target is buried.

20. The method of claim 13, wherein the increased voltage is greater than about 10 kV.

21. The method of claim 13, wherein the pulsed electrical energy is pulsed at a pulse repetition rate of greater than about 100 Hz.

22. The method of claim 13, wherein the loosely coupled transformer has a coupling coefficient of approximately 0.1.

23. A system for disabling an electrical target, including:

a power supply operable to provide electrical energy;

a loosely coupled transformer coupled to the power supply and operable to increase voltage of the electrical energy;

an electrode coupled to the loosely coupled transformer and operable to initiate a discharge of the electrical energy between the electrode and the electrical target; and a controller operable to pulse the electrical energy discharge to the electrical target to disable the electrical target; and a thyratron communicatively coupled to the controller and operable to pulse the electrical energy through a primary coil of the loosely coupled transformer.

24. The system of claim 23, further including an energy booster operable to maintain the electrical energy discharge to the target.

25. The system of claim 24, wherein the controller is further operable to decouple the loosely coupled transformer from the electrode to relieve energy consumption of the power supply while the energy booster maintains the electrical energy discharge to the target.

* * * * *